US006695071B1

(12) United States Patent
DeVall

(10) Patent No.: US 6,695,071 B1
(45) Date of Patent: Feb. 24, 2004

(54) DRILL HEAD ASSEMBLY

(76) Inventor: Donald L. DeVall, 1082 Charles Ave., Morgantown, WV (US) 26505

( * ) Notice: Subject to any disclaimer, the term of this patent is extended or adjusted under 35 U.S.C. 154(b) by 0 days.

(21) Appl. No.: 10/231,327

(22) Filed: Aug. 29, 2002

(51) Int. Cl.[7] ..... E21B 7/00

(52) U.S. Cl. ..... 173/1; 173/53; 173/132; 173/213

(58) Field of Search ..... 173/1, 74, 78, 173/79, 105, 197, 198, 199, 216, 218, DIG. 3, 149; 279/57, 74, 121; 175/320

(56) References Cited

U.S. PATENT DOCUMENTS

| | | | | | |
|---|---|---|---|---|---|
| 3,692,320 | A | | 9/1972 | Lindelof et al. | 279/4 |
| 3,736,993 | A | * | 6/1973 | West | 173/163 |
| 3,792,869 | A | | 2/1974 | Braun | 279/4 |
| 3,800,887 | A | * | 4/1974 | West | 173/197 |
| 3,990,522 | A | | 11/1976 | Pyles et al. | 173/78 |
| 3,992,019 | A | | 11/1976 | Crawshay | 279/4 |
| 4,190,116 | A | | 2/1980 | O'Neal et al. | 173/38 |
| 4,294,317 | A | * | 10/1981 | Amoroso | 173/198 |
| 4,298,073 | A | * | 11/1981 | Yates | 173/198 |
| 4,393,945 | A | * | 7/1983 | Rassieur | 173/163 |
| 4,416,337 | A | | 11/1983 | Phillips et al. | 173/57 |
| 4,423,645 | A | * | 1/1984 | Abbott et al. | 74/810.1 |
| 4,540,187 | A | * | 9/1985 | Morawski et al. | 279/2.04 |
| 4,773,491 | A | * | 9/1988 | Shy | 175/385 |
| 4,815,546 | A | * | 3/1989 | Haney et al. | 173/197 |
| 5,195,598 | A | | 3/1993 | DeVall | 173/197 |
| 5,370,194 | A | * | 12/1994 | Anderson | 173/216 |
| 5,492,183 | A | | 2/1996 | Sollami | 173/216 |
| 5,690,183 | A | | 11/1997 | Sollami | 173/216 |
| 5,820,137 | A | * | 10/1998 | Patterson | 279/141 |
| 6,170,835 | B1 | * | 1/2001 | Noss | 279/2.07 |

* cited by examiner

*Primary Examiner*—Scott A. Smith
*Assistant Examiner*—Chukwurah Nathaniel
(74) *Attorney, Agent, or Firm*—Price & Adams

(57) ABSTRACT

A drill head for holding a drill steel includes a drill housing having an internal cavity defined by an upper opening and a lower portion with a lower opening extending therethrough. The internal cavity includes a pair of concentric axially aligned sleeves. An internal sleeve has an inner surface for receiving a drill steel and an outer tapered surface. An external sleeve has an internal tapered mating surface for receiving the internal sleeve. The drill head also includes a sliding member for receiving hydraulic pressure to move the internal sleeve on the tapered surface of the external sleeve into gripping engagement of the drill steel. A Belleville spring provides an opposing force to normally maintain the internal sleeve out of gripping engagement with the drill steel.

20 Claims, 3 Drawing Sheets

DRILL HEAD ASSEMBLY

BACKGROUND OF THE INVENTION

1. Field of the Invention

This invention relates to method and apparatus for holding a drill steel in a drill head assembly and, more particularly, to method and apparatus for sliding a tubular member in the drill head assembly into and out of gripping engagement with the drill steel.

2. Description of the Prior Art

In rock drilling operations, it is conventionally known practice to drill holes in a rock formation by a rotary drill assembly or by a rotary percussion drill assembly. These assemblies include a drill pot that carries a hydraulic motor having a motor shaft rotatably connected to a bevel gear which meshes with another bevel gear rotatably journaled on a support member or hub within the drill housing. It is affixed to a rotatable head or cover, which has a seat into which the shank of a drill steel is received. A drill bit is positioned on the upper end of the drill steel. With this arrangement, rotation of the motor shaft is transmitted to the drill steel to rotate the drill bit.

Generally, the drill assembly is carried by a self-propelled machine that maneuvers the drill pot into position and in a direction to advance the drill bit into the rock formation. For rock drilling operations in an underground mine, the drill assembly is supported by a boom that is pivotally mounted on the front of a mobile frame. Upward movement of the boom moves the drill steel seated in a drill pot into drilling position. The boom exerts upward pressure on the drill assembly to increase the driving thrust of the drill steel. As a result, the drill steel advances vertically into the rock formation to dislodge rock materials and form an elongated bore in the rock formation to receive a mine roof bolt.

The upward force exerted upon the drill assembly by the boom overcomes resistance of the rock structure to rotation of the drill bit. Such conditions establish the need for drill assembly configurations that increase the amount of torque applied to the drill steel and decrease drill steel slippage. Dust is also a problem that causes deterioration of the gearing and bearings of drill assemblies. Therefore extensive seal arrangements are used on the drill head assemblies.

Many examples of drill head assemblies are known in the art. U.S. Pat. No. 5,195,598 discloses a typical drill head assembly for rock drill operations. The drill head assembly includes a rotary drill head having a cover with a flinger that can easily be removed from the drill head assembly. U.S. Pat. No. 3,990,552 discloses a drill head that is part of a rotary percussion drill. U.S. Pat. No. 4,190,116 discloses a rotary drill head that is part of a mine roof bolter.

U.S. Pat. Nos. 5,492,183 and 5,690,183 disclose a drill head unit with a drill chuck. The drill chuck includes a cylindrical central section with steel balls for holding a drill steel in place.

Some drill head assemblies include an actuator and spring that cooperate to position jaws to grip a drill steel. U.S. Pat. No. 3,792,869 discloses a drill head having a chuck apparatus with a plurality of jaws for gripping a drill steel. The jaws are not positioned circumferentially to uniformly grip the drill steel. The chuck apparatus includes springs that cooperate with a jaw actuator to position the jaws to grip the drill steel, but the springs resiliently urge the jaws radially inwardly and outwardly.

U.S. Pat. No. 3,992,019 discloses a drill head having a hydraulic powered drill chuck. A hydraulic powered cylinder drives a collet sleeve. The collet sleeve slides against the chuck jaws. The jaws move in a radial direction to grip the drill steel and are not positioned to circumferentially grip the drill steel. Multiple Belleville springs are disclosed, but the Belleville springs do not resiliently urge the jaws in an axial direction.

U.S. Pat. No. 3,692,320 discloses a hydraulic powered drill chuck assembly. The chuck assembly includes a plurality of cylindrical jaws that clamp against a tubular, cylindrical drill stem rod. Each jaw has an outer tapered surface that slides on an inner tapered surface of a protrusion. However, the outer surface does not circumferentially grip the drill steel and is not a mating surface with the inner tapered surface. U.S. Pat. No. 3,692,320 also discloses a Belleville spring and spring plate; however, the Belleville spring moves the jaws in an outward radial direction and does not slide the jaws in an axial direction.

U.S. Pat. No. 4,416,337 discloses a rotary drill assembly having a rotary motor mounted on a drill head. The drill head includes a housing having an internal cavity for holding a rotatable chuck. The drill chuck includes a socket for receiving the shank of the drill steel. The socket is dimensioned to nonrotatably receive the drill steel shank. There is no provision for adjusting the dimension of the socket to increase the gripping engagement of the shank in the socket.

There is need in a drill head assembly for a chuck having a socket that can be moved into and out of gripping engagement with a drill steel shank to securely retain the drill steel in the chuck in operation and to efficiently move the drill steel into and out of position in the chuck.

SUMMARY OF THE INVENTION

In accordance with the present invention there is provided a drill head for holding a drill steel that includes a drill housing having an internal cavity defined by an upper opening and a lower portion with a lower opening extending therethrough. An internal sleeve is axially positioned within the cavity and has a tapered external surface and an axial internal bore for receiving the drill steel in frictional engagement. An external sleeve is coaxially aligned with the internal sleeve in the internal cavity. The external sleeve has an internal tapered surface for mating with the external tapered surface of the internal sleeve. A sliding member is positioned for vertical movement in the lower portion of the internal cavity. The sliding member receives hydraulic pressure through the lower opening for moving upwardly to urge the internal sleeve external surface against the external sleeve in response to the hydraulic pressure. A resilient member provides an opposing force to position the internal sleeve to maintain frictional engagement with the drill steel in the internal bore.

Further in accordance with the present invention, there is provided a drill head for gripping a drill steel that includes a drill housing having an internal cavity defined by an upper opening and a lower portion with a lower opening extending therethrough. An inner tubular member is axially positioned within the cavity and has an internal mating surface for receiving a lower end portion of the drill steel and a tapered mating outer surface. An outer tubular member is axially positioned within the cavity and surrounds the inner tubular member and has a mating tapered inner surface for slidably receiving the outer surface of the inner tubular member. A plunger is positioned within the lower end portion of the cavity for sliding the outer tubular member against the inner tubular member. A piston receives hydraulic pressure through the lower opening of the housing and urges the plunger in an axial direction. A resilient member urges the inner tubular member in an axial direction to grip said drill steel.

Additionally, in accordance with the present invention, there is provided a method for gripping a drill steel that includes the steps of receiving a thrusting force from a piston. A drill steel is inserted into an internal bore within a first tubular member. The thrusting force is transferred to the first tubular member to slide the first tubular member against a tapered mating surface of a second concentric tubular member in an axial direction. An opposing force is applied to the first tubular member to normally maintain the first tubular member removed from gripping engagement with the drill steel.

Accordingly, a principal object of the present invention is to provide a drill head assembly having an inner sleeve for uniformly gripping a drill steel.

Another object of the present invention is to provide hydraulic pressure to slide a tubular member to grip a drill steel.

A further object of the present invention is to position a tubular member to grip a drill steel by sliding the tubular member in response to hydraulic pressure and providing a responsive force with a resilient member.

A further object of the present invention is to provide a drill head assembly to uniformly grip a drill steel.

An additional object of the present invention is to provide a drill head assembly providing a grip for a drill steel having lower slippage.

An additional object of the present invention is to provide a drill head assembly that provides a more efficient amount of torque to the drill steel.

These and other objects of the present invention will be more completely described and disclosed in the following specification, accompanying drawings, and appended claims.

DESCRIPTION OF THE PREFERRED EMBODIMENTS

Figure 1:
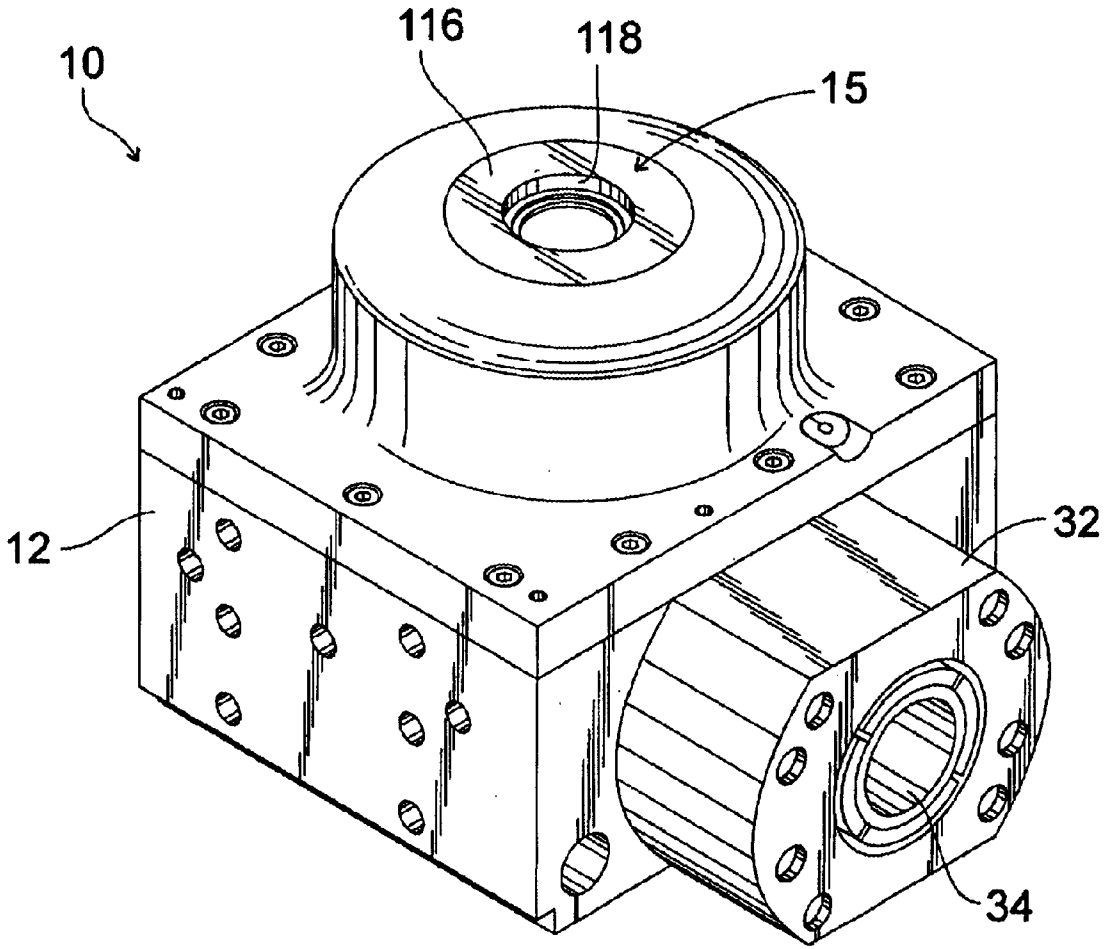
FIG. 1 is an isometric view of a drill head assembly of the present invention.
Figure 2:
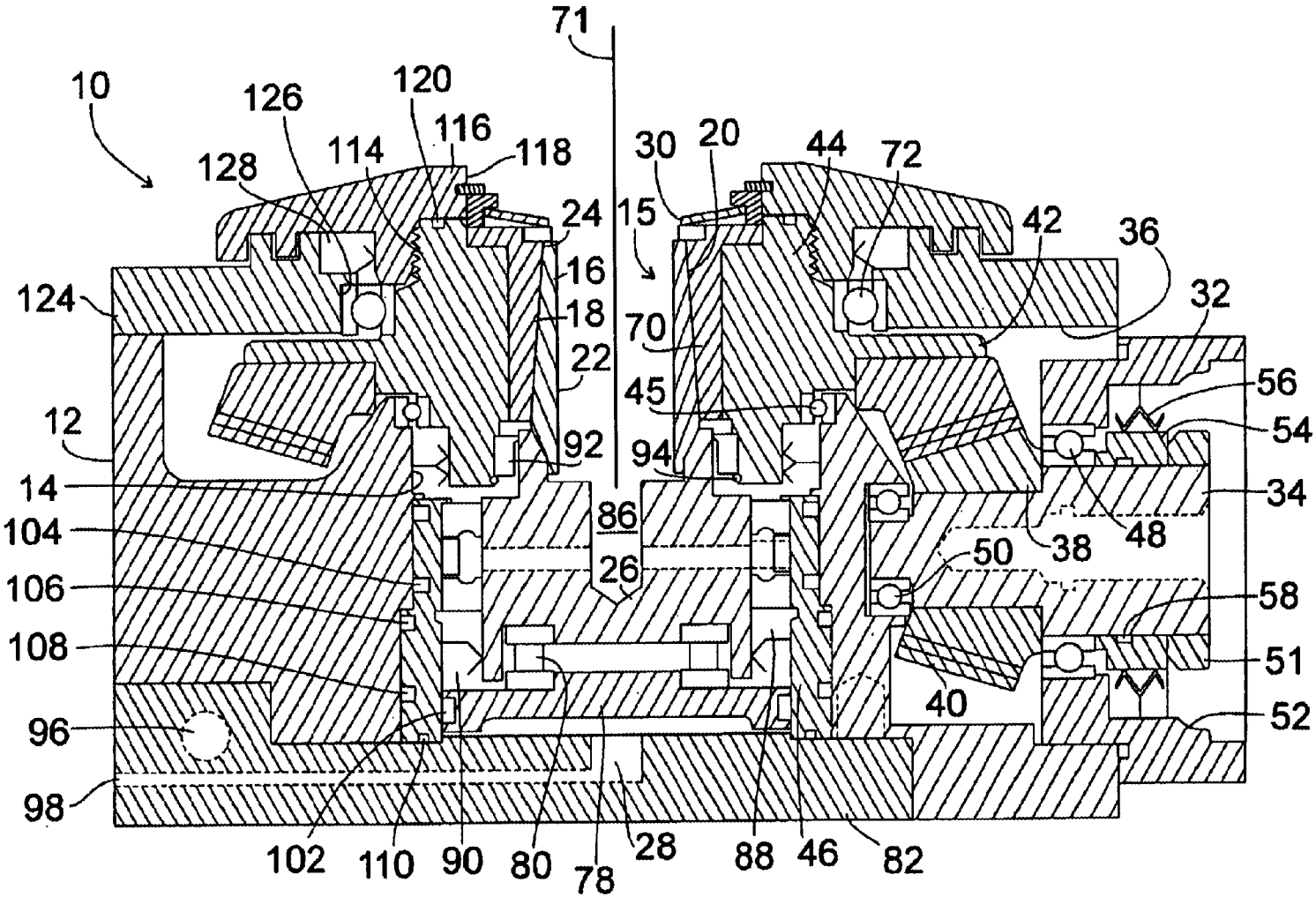
FIG. 2 is a sectional view in side elevation of the drill head assembly for gripping and holding a drill steel.

Referring to the drawings and, particularly, to FIGS. 1 and 2 there is illustrated an improved rotary drill assembly generally designated by the numeral 10 for holding a drill steel (not shown) in rock drilling operations. The rotary drill assembly 10 is particularly adapted for use in drilling bolt holes in a mine roof of an underground mine, as described in U.S. Pat. No. 4,416,337. The drill steel includes a drill bit at its upper end portion for dislodging rock material. The drill steel and drill bit are centrally bored to facilitate removal from the drilled hole rock dust ground by the bit.

The drill head assembly 10 includes an external drill housing 12 having an axially aligned internal cavity 14 that includes an upper opening and a lower portion with an opening therethrough. A drill chuck generally designated by the numeral 15 in the cavity 14 receives the drill steel. A pair of concentric axially aligned sleeves, such as collet 16 and bushing 18, are positioned within the internal cavity 14.

Figure 3:
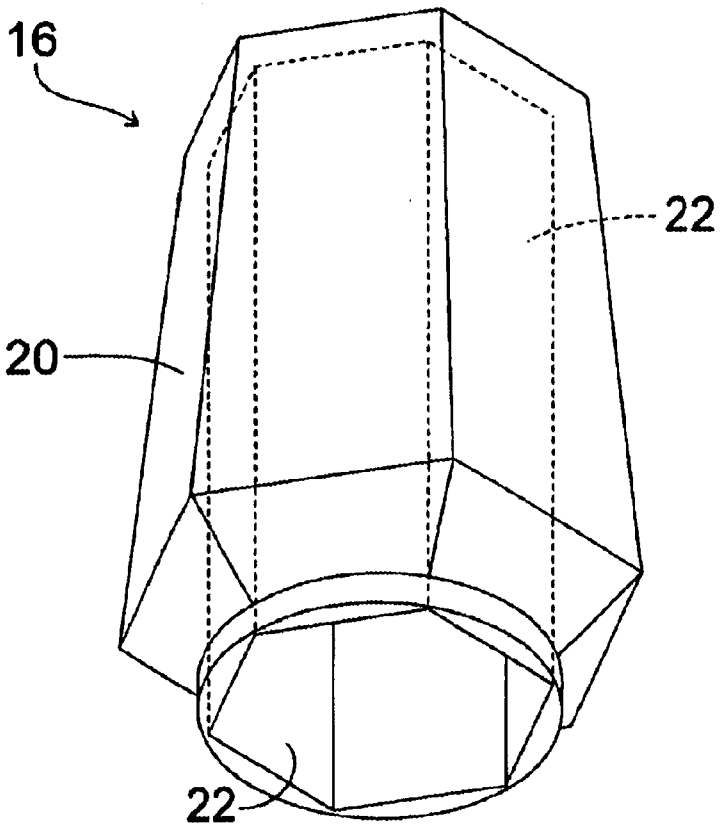
FIG. 3 is an isometric view of the collet for the drill head assembly shown in FIG. 2.
Figure 4:
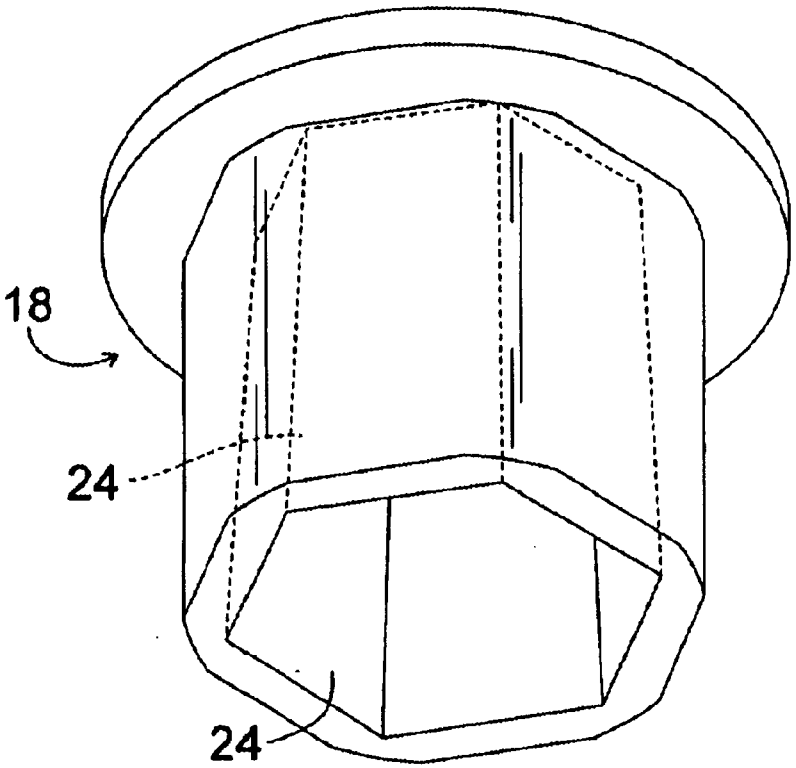
FIG. 4 is an isometric view of the bushing for the drill head assembly shown in FIG. 2.

The collet 16, as shown in FIG. 3, includes a hex on the outer diameter forming an external tapered surface 20 and an axial internal bore forming an internal surface 22 to fit the drill steel. The internal surface 22 surrounds and uniformly grips the drill steel. The external sleeve or bushing 18, as shown in FIG. 4, surrounds the collet 16 and includes on the inner diameter a tapered hexagonal surface 24 for mating with the tapered hexagonal surface 20 on the outer diameter of collet 16.

A sliding member or plunger 26 is positioned in the internal cavity 14 below the collet 16 and bushing 18. The plunger 26 receives hydraulic pressure through an opening 28 in the housing 12, Under hydraulic pressure, the plunger 26 pushes the collet 16 upward on the tapered internal surface 24 of bushing 18 to frictionally and nonrotatably engage the drill steel. A resilient member 30, such as a Belleville spring assembly, is positioned above the collet 16 and bushing 18. The plunger 26 pushes the collet 16 upwardly, compressing the spring 30, resulting in tightening of the collet 16 with the drill steel.

The cooperation between the plunger 26, bushing 18 and spring 30 generates clamping of the collet 16 against the drill steel. The clamping arrangement is more efficient because a greater amount of torque is applied to the drill steel than provided by the prior art clamping arrangements.

As shown in FIGS. 1 and 2, a pinion housing 32 is nonrotatably mounted on the external housing 12 and rotatably supports a pinion shaft 34 that extends through an opening of the pinion housing 32 into an internal cavity 36 of the external housing 12. A ring gear 38 and bevel pinion 40 are positioned in the internal cavity 36 and nonrotatably connected to the end of the pinion shaft 34. The pinion 40 is drivingly connected to a flange 42 of a drive shaft 44. The shaft 44 is rotatably supported by bearings 45 in the upper portion of external housing 12.

A rotary motor (not shown) is drivingly connected to the pinion shaft 34. The rotary motor is remotely controlled to rotate the pinion shaft 34 at a preselected speed. Rotation is transmitted from shaft 34 through the ring gear 38 and bevel pinion 40 to the drive shaft 44. The shaft 44 is rotatably supported by bearings 45 which are mounted on the drill housing 12.

The bevel pinion 40 and the ring gear 38 are positioned in cavity 36. The pinion shaft 34 is also rotatably supported in cavity 36 by bearings 48, 50. The shaft 34 extends through opening 52 of pinion housing 32 and is rotatably supported by the bearings 48 and 50 and held in place by nut 51 and seal ring 54. The ring 54 is externally sealed in the pinion housing 32 by seal 56 and internally sealed by O-ring 58 around pinion shaft 34. The seal 56 and O-ring 58 surround the pinion shaft 34 to protect the bearings 48, 50 from dust.

The drive shaft 44 is positioned within an upper portion of the cavity 14 of the housing 12. The shaft 44 includes an axial aligned internal bore 70 with a centerline 71 for receiving collet 16 and bushing 18. The collet 16 and bushing 18 are coaxially aligned with the centerline 71 in the drive shaft bore 70. Bearings 45 and 72 rotatably support the drive shaft 44 axially within the housing cavity 14.

The collet 16 is positioned above the plunger 26. The plunger 26 is supported by thrust bearing 80 on a piston 78. The plunger 26 is positioned within a lower portion of the cavity 14 which is sealed by a bottom plate 82. In another embodiment bottom plate 82 includes a sealed opening (not shown) through which dust is removed from the bottom of the drill head assembly 10. The collet 16 is non-rotatably connected to the plunger 26. The lower portion of the drill steel (not shown) is received within a lower recess 86 of collet 16.

The plunger 26 is supported by the thrust bearings 80 for sliding in an axial direction on centerline 71 within the lower portion of the cavity 14. The plunger 26 is maintained in axial alignment within the housing 12 by a spacer 86 positioned between the housing 12 and plunger 26. Below the spacer 86, the cavity 14 is sealed above the piston 78 by seals 88 and 90. The upper end of plunger 26 is surrounded by seal 92 which is retained within the drive shaft 44 by snap ring 94. The seals 88, 90, and 92 prevent dust from harming the thrust bearing 80 as the plunger 26 moves within the cavity 14.

The plunger 26 cooperates with the piston 78 and the thrust bearing 80 to move the collet 16 upwardly in the housing 12. The thrust bearing 80 is positioned between the plunger 28 and the piston 78. Pressurized hydraulic fluid is injected from a cartridge 96 through a passageway 98 in bottom plate 82 to the base of piston 78. The upward force is transmitted through the thrust bearing 80 in an axial direction to the plunger 26 to move the plunger 26 upwardly.

The piston 78 is part of the hydraulic system that controls clamping of the drill steel by the collet 16 moving upwardly on the internal tapered surface of the bushing 18 under the force of hydraulic pressure applied to the piston 78 and plunger 26. The piston 78 is positioned for vertical reciprocal movement within an internal housing 46, which acts as a cylinder in the hydraulic system. A cup 102 retained on the outer surface of the piston 78 allows the piston 78 to slide up and down on the internal surface of housing 46. The housing 46 is sealed by O-rings 104, 106, 108, and 110 to prevent leakage of the hydraulic fluid from housing 46.

When the passageway 98 is pressurized with hydraulic fluid, the piston 78 moves upwardly in housing 46 to exert an upward force on the plunger 26, resulting in upward movement of the collet 16 and compression of the Belleville spring 30. Consequently, the collet 16 frictionally engages the drill steel as the collet 16 advances up the tapered internal wall of bushing 18.

As shown in FIG. 2, the drive shaft 44 includes an externally threaded portion 114 that is arranged to receive in meshing engagement the internal threads of a flinger 116. The flinger 116 has an internal bore 118 of a diameter sized to permit ease of insertion and removal of a drill steel. The opening 118 extends into the bore 70 of the drill shaft 44. The collet 16, bushing 18, and shaft 44 are positioned below the opening 118. An O-ring 120 seals the opening between the drive shaft 44 and the flinger 116.

The Belleville spring 30 is retained on the upper shoulder of the bushing 18 and applies a biasing force to the upper shoulder of the collet 16 to normally maintain the collet 16 in a lowermost position in the drill chuck 15. In this position of the collet 16, the drill steel is freely movable into and out of position therein. When the cartridge 96 is actuated to pressurize the internal housing 46 below the piston 78, an upward force is applied through the piston 78 and plunger 26 to the collet 16 to overcome the downward force applied by the Belleville spring 30. In this manner, the collet 16 moves upwardly and frictionally, nonrotatably engages the drill steel in the drill chuck 15.

A pressure relief valve (not shown) associated with the cartridge 96 sets the hydraulic pressure at a magnitude to move the piston 78 upwardly against the downward force exerted by the Belleville spring 30 and urge the collet 16 into clamping engagement with the drill steel. The pressure is maintained to keep the collet 16 nonrotatably engaged to the drill steel for rotation of the drill steel. When the hydraulic pressure is released, the Belleville spring 30 moves the collet 16 downwardly in the drill chuck 15 to relieve the clamping force applied to the drill steel. This permits the drill steel to be removed from the chuck 15.

The flinger 116 nonrotatably meshes with a cover plate 124. The cover plate 124 includes a bore 126 that receives bearing 72 for rotatably supporting the drive shaft 44. Seal 128 is positioned between the cover plate 124 and the flinger 116. The seal 128 prevents dirt from entering between the cover plate 124 and the flinger 116 into the bore 126.

Upon actuation of the hydraulic system, the collet 16 slides upwardly in an axial direction on centerline 71 to compress the Belleville spring 30 against the flinger 116. The Belleville spring 30 compresses against the flinger 116 to allow the collet 16 to move upwardly into clamping engagement with the drill steel.

The cross section of the collet 16 can be any suitable shape. In the preferred embodiment the cross section of the collet 16 is hexagonal. The internal surface 22 of the collet 16 mates with the surface of the drill steel. The cross section of the bushing 18 is also hexagonal in the preferred embodiment. The internal surface of the drive shaft 44 is a mating surface with the bushing 18.

In operation, the gripping of the drill steel is actuated by the hydraulic system. The hydraulic system delivers fluid under pressure through the passageway 98. The fluid generates a force to slide the piston 78 in an upward direction in the housing 46 against the downward bias of the Belleville spring 30. The piston 78 transfers the upward force through the thrust bearing 80 to the plunger 26. Upward movement of the plunger 26 advances the collet 16 up the internal tapered surface of the bushing 18 to clamp the drill steel in the chuck 15.

The collet 16 slides inside the bushing 18 and compresses the Belleville spring 30 against the flinger 116 to allow upward movement of collet 16 to clamp the drill steel. Upon release of the hydraulic pressure, the Belleville spring 30 resists the reduced upward force and expands to move the collet 16 downwardly in the bushing 18 out of clamping engagement with the drill steel. Thus, the Belleville spring 30 and the plunger 26 cooperate to move the collet 16 in and out of engagement with the drill steel.

It should be understood that alternative drill assemblies are contemplated in accordance with the present invention and include telescoping tubular shaped members with tapered mating surfaces. In another embodiment, the plunger urges an outer tubular member to slide against the inner tubular member to grip the drill steel. Furthermore, the drill steel clamping mechanism, above described, is adaptable to any drilling operation and is not limited to mining applications. It is equally adaptable to a percussion drill head assembly.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A drill head for holding a drill steel comprising:

a drill housing having an internal cavity defined by an upper opening and a lower portion with an opening extending therethrough, an internal sleeve axially positioned within said cavity and having a tapered external surface and an axial internal bore for receiving the drill steel in frictional engagement, an external sleeve coaxially aligned with said internal sleeve in said internal cavity, said external sleeve having an internal tapered surface for mating with said external tapered surface of said internal sleeve, a sliding member positioned for vertical movement in said lower portion of said internal cavity, said sliding member receiving hydraulic pressure through said lower opening for moving upwardly to urge said internal sleeve against said external sleeve in response to said hydraulic pressure, and a resilient member providing a force to normally position said internal sleeve removed from frictional engagement with the drill steel within said internal bore.

2. A drill head as set forth in claim 1 in which:

said sliding member urges said internal sleeve to slide against said external sleeve.

3. A drill head as set forth in claim 1 in which:

said inner surface of said internal sleeve includes a mating surface to mate with a lower end portion of the drill steel.

4. A drill head as set forth in claim 1 which includes:

a shaft having an inner bore for housing said external sleeve.

5. A drill head as set forth in claim 4 in which:

said inner bore of said shaft has a recess for receiving a lower end portion of said drill steel.

6. A drill head as set forth in claim 1 in which:

said sliding member includes a plunger and a piston, said piston receiving hydraulic pressure from said lower opening and urging said plunger in an axial direction.

7. A drill head as set forth in claim 6 which includes:

a thrust bearing for receiving force from said piston and for urging said plunger in an axial direction.

8. A drill head as set forth in claim 1 which includes:

a flinger for sealing said drill housing cavity and retaining said sliding member therein.

9. A drill head in as set forth in claim 1 which includes:

pressure means for maintaining said sliding member in a position said drill housing internal cavity for frictional engagement of said internal sleeve with the drill steel.

10. A drill head as set forth in claim 1 in which:

said resilient member includes a Belleville spring.

11. A drill head as set forth in claim 10 in which:

said internal sleeve includes a collet, said external sleeve includes a bushing, and said sliding member includes a piston, a plurality of thrust bearings and a plunger.

12. A drill head for gripping a drill steel comprising:

a drill housing having an internal cavity defined by an upper opening and a lower portion with a lower opening extending therethrough, an inner tubular member axially positioned within said cavity and having an internal mating surface for receiving a lower end portion of the drill steel and having a tapered mating outer surface, an outer tubular member axially positioned within said cavity and surrounding said inner tubular member and having a mating tapered inner surface for slidably receiving said outer surface of said inner tubular member, a plunger positioned within said lower end portion of said cavity for sliding the outer tubular member against the inner tubular member, a piston receiving hydraulic pressure through said lower opening of said housing for urging said plunger in an axial direction, and a resilient member urging said inner tubular member in an axial direction to grip the drill steel.

13. A drill head as set forth in claim 12 in which:

said inner tubular member circumferentially and uniformly grips the drill steel.

14. A drill head as set forth in claim 12 which includes:

a tubular shaft having an internal bore for receiving said external tubular member and said internal tubular member, said internal tubular member aligning axially in said bore, and said external tubular member aligning axially in said bore and surrounding said internal tubular member.

15. A drill head as set forth in claim 12 which includes:

a flinger for retaining said resilient member in said drill housing internal cavity.

16. A drill head as set forth in claim 12 which includes:

a thrust bearing positioned on said plunger for supporting said piston for rotational and vertical movement in said drill housing internal cavity, and said thrust bearing receiving a force from said piston and transferring the force to said plunger to urge said plunger slide in an axial direction.

17. A drill head as set forth in claim 12 which includes:

a locking device for maintaining said piston in a position in said drill housing to keep said inner tubular member in gripping engagement with the drill steel.

18. A drill head as set forth in claim 12 in which:

said resilient member includes a Belleville spring.

19. A method for gripping a drill steel comprising:

inserting a drill steel into an internal bore of first tubular member, receiving a thrusting force from a piston, transferring the thrusting force from the piston to the first tubular member to slide the first tubular member against a tapered mating surface of a second concentric tubular member in an axial direction, and applying a force to the first tubular member to normally maintain the first tubular member removed from gripping engagement with the drill steel.

20. A method as set forth in claim 19 which includes:

transferring the thrusting force from the piston through a thrust bearing to a plunger abutting the first tubular member for moving the first tubular member into frictional engagement with the drill steel.

* * * * *